US006347200B1

(12) United States Patent
Shigeta et al.

(10) Patent No.: US 6,347,200 B1
(45) Date of Patent: Feb. 12, 2002

(54) DUPLEX IMAGE FORMING APPARATUS

(75) Inventors: Kunio Shigeta; Yotaro Sato; Hisayoshi Nagase; Satoshi Haneda, all of Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/698,951

(22) Filed: Oct. 27, 2000

(30) Foreign Application Priority Data

Nov. 1, 1999 (JP) ..... 11-310923

(51) Int. Cl.[7] ..... G03G 15/16; G03G 15/22

(52) U.S. Cl. ..... 399/66; 399/306; 399/308; 399/309

(58) Field of Search ..... 399/302, 303, 399/306, 308, 309, 310, 364, 66

(56) References Cited

U.S. PATENT DOCUMENTS 5,761,573 A * 6/1998 Haneda et al. ..... 399/66
5,799,226 A * 8/1998 Shigeta et al. ..... 399/66
5,905,931 A * 5/1999 Shigeta et al. ..... 399/309
5,970,277 A * 10/1999 Shigeta et al. ..... 399/306 X
6,064,848 A * 5/2000 Haneda ..... 399/302
6,205,301 B1 * 3/2001 Shigeta et al. ..... 399/66

* cited by examiner

*Primary Examiner*—Susan S. Y. Lee
(74) *Attorney, Agent, or Firm*—Frishauf, Holtz, Goodman, Langer & Chick, P.C.

(57) ABSTRACT

The present invention concerns a duplex image forming apparatus, which can form images on both sides of a transfer sheet by employing an intermediate transfer element. The duplex image forming apparatus includes an image bearing member; a toner image forming section to form a toner image on the image bearing member; an intermediate transfer element, shaped like a belt, to bear the toner image transferred from the image bearing member and to convey a transfer sheet; a transfer sheet charging device to apply a bias voltage onto the transfer sheet at the charging position, so that the transfer sheet adheres onto the intermediate transfer element; a first transfer device to transfer the toner image onto the transfer sheet or the intermediate transfer element; a second transfer device to transfer the toner image borne on the intermediate transfer element onto the transfer sheet; and a control section to control a transfer current or a transfer voltage applied to the first transfer device.

14 Claims, 9 Drawing Sheets

FIG. 3 ( A )
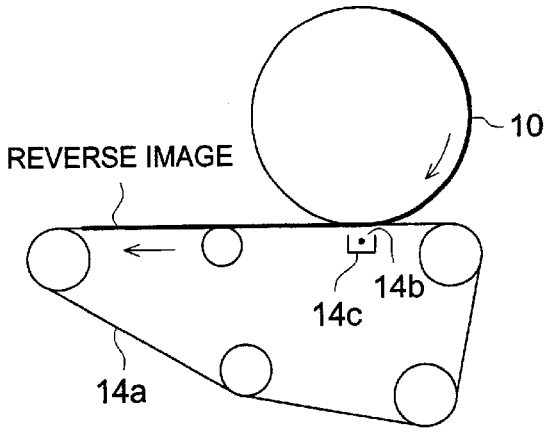
FIG. 3 ( B )
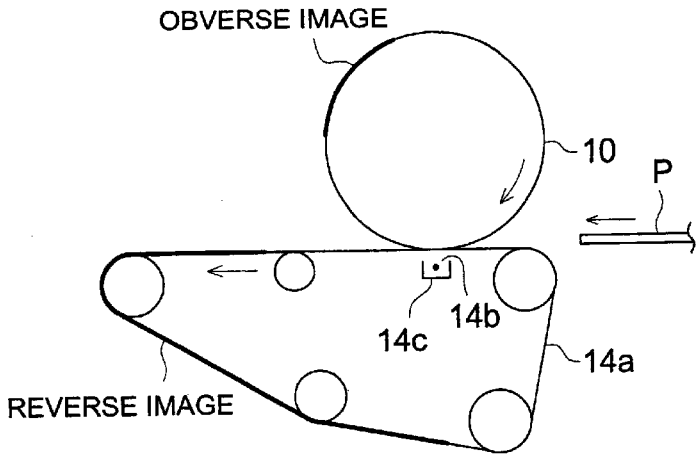
FIG. 3 ( C )
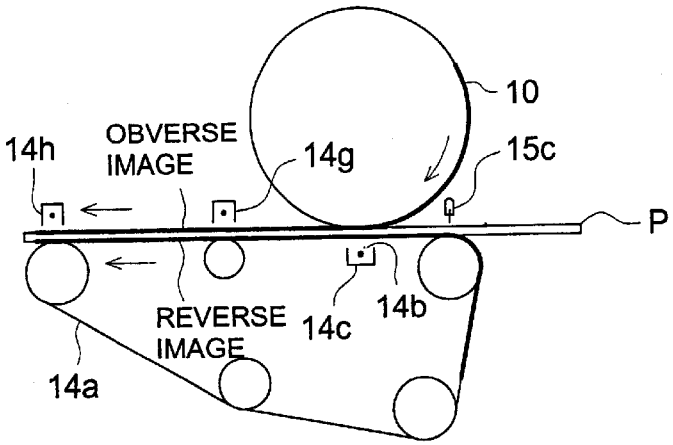

DUPLEX IMAGE FORMING APPARATUS

BACKGROUND OF THE INVENTION

The present invention relates to image forming apparatus employing an electro-photographic method, such as copiers, printers, facsimile devices, etc., in which a charging means, an image writing means and a developing means are disposed around the circumferential surface of an image bearing member to form a toner image, which is transferred and fixed on a transfer sheet, and specifically relates to a duplex image forming apparatus which can form images on both sides of a transfer sheet by employing an intermediate transfer belt.

In a conventional duplex image forming apparatus, a toner image of one side, formed on the image bearing member, is transferred and fixed on the transfer sheet to be temporarily stored in the reversible feeding device after the fixing operation. Then, the transfer sheet is fed from the reversible feeding device, synchronized with another toner image formed again on the image-bearing member, to transfer and fix the other toner image onto the other side of the transfer sheet.

In the conventional duplex image forming apparatus, since the transfer sheet should be conveyed to the reversible feeding device and should be pass through the fixing device twice, as mentioned above, the transfer sheet is compelled to pass through a very complicated conveyance path, which deteriorates a reliability of the conveying operation for the transfer sheet and causes jams and wrinkles of the transfer sheet.

To overcome the abovementioned problems, the duplex image forming apparatus, in which toner images, formed on the both sides of the transfer sheet by employing both the image bearing member and the intermediate transfer member, are fixed onto the transfer sheet at a time, are set forth in Tokkaishou 49-37538, Tokkaishou 54-28740, Tokkaihei 1-44457 and Tokkaihei 4-21576.

Further, the present inventors have disclosed the method and apparatus for forming duplex color images set forth in Tokkaihei 9-258492 and Tokkaihei 9-258516, in which a plurality of sets, each of which is comprised of a charging means, an image writing means and a developing means, are arranged around the circumferential surface of the photoreceptor drum, and the superimposed color toner image formed on the photoreceptor drum is collectively transferred onto the intermediate transfer member, and then, the transfer sheet is conveyed on the intermediate transfer member, synchronizing with the superimposed color toner image formed again on the photoreceptor drum and the toner image already transferred on the intermediate transfer member, and during the conveying operation of the transfer sheet, the toner image formed again on the photoreceptor drum is transferred onto one side of the transfer sheet as the obverse side image while the toner image already transferred on the intermediate transfer member is transferred onto the other side of the transfer sheet as the reverse side image, and then, the transfer sheet is separated from the intermediate transfer member to fix the toner images onto the transfer sheet at a time, and thus, the duplex color images can be formed.

In the duplex image forming apparatus which forms images on both sides of the transfer sheet by employing an intermediate transfer belt, serving as a belt-shaped intermediate transfer member as mentioned above, there are provided a transfer sheet charging means for charging the transfer sheet, such as a recording sheet, etc., to convey the transfer sheet along the intermediate transfer belt while the transfer sheet is electro-statically adhering onto it, a first transfer means for transferring a toner image, formed on the image bearing member, onto the intermediate transfer belt or the obverse side of the transfer sheet, and a second transfer means for re-transferring the toner image, already transferred on the intermediate transfer belt, onto the reverse side of the transfer sheet.

When the transfer sheet is conveyed on the intermediate transfer belt during the duplex image forming operation, a bias voltage is applied to the transfer sheet charging means, the first transfer means and the second transfer means, in order to transfer good toner images onto the both sides of the transfer sheet. Incidentally, in the system for forming the abovementioned duplex images, the transfer sheet charging means, the first transfer means and the second transfer means are disposed at positions as described in the following.

Initially, the first transfer means is disposed at a position backside the intermediate transfer belt, where the photoreceptor drum opposes to the intermediate transfer belt, to supply electronic charge onto the backside surface of the intermediate transfer belt (for instance, the lower side surface of the transfer sheet shown in FIG. 1). In this configuration, a toner image formed on the photoreceptor drum is transferred onto one side of the transfer sheet (for instance, the upper side surface of the transfer sheet shown in FIG. 1), which is conveyed by the intermediate transfer belt while electro-statically adhering on it.

On the other hand, the second transfer means is disposed at a position, located downstream the position of the first transfer means and at a front-side of the intermediate transfer belt, to directly supply electronic charge onto the opposite side surface of the transfer sheet (for instance, the upper side surface of the transfer sheet shown in FIG. 1), which is conveyed by the intermediate transfer belt while electrostatically adhering on it. In this configuration, a toner image already transferred on the intermediate transfer belt is transferred onto the other side of the transfer sheet (for instance, the lower side surface of the transfer sheet shown in FIG. 1).

Further, the transfer sheet charging means is disposed at a position, located upstream the position of the first transfer means and at a front-side the intermediate transfer belt, to directly supply electronic charge onto the upper side surface of the transfer sheet, shown in FIG. 1, which is fed on the intermediate transfer belt, so that the transfer sheet electrostatically adheres onto the intermediate transfer belt.

Accordingly, in the system for forming the duplex images on the both sides of the transfer sheet at a time, the first transfer means indirectly supplies electronic charge to one side of the transfer sheet with putting the intermediate transfer belt between them, while the second transfer means or the transfer sheet charging means directly supplies electronic charge to the other side (opposite side) of the transfer sheet.

The present inventors have found a problem that the electronic charge, applied to one side of the transfer sheet, and the other electronic charge, applied to the other side of the transfer sheet, interfere each other in the system mentioned above. Namely, the present inventors have found that, since the relative position of the transfer sheet, with respect to the positions of the transfer sheet charging means, the first transfer means and the second transfer means, varies depending on the current position of the transfer sheet as convying with the intermediate transfer belt, presence or absence of the interference between electronic charges supplied to the both sides of the transfer sheet considerably affects the quality of the toner images.

Specifically in the duplex image forming apparatus, incorporating the intermediate transfer belt, it is also found that a delicate variation of the electronic resistance of the transfer sheet or that of the intermediate transfer belt considerably affects the interfering action between electronic charges residing on the both sides of the transfer sheet. The abovementioned interfering action gives far greater influences to the transfer sheet than that in image forming apparatus, which forms a toner image on only one side of the transfer sheet.

Owing to the interfering action in the abovementioned duplex image forming apparatus, there has been a problem that an unevenness of the density like a stripped pattern is generated in the transferred images, when the ambient humidity is high, or the transfer sheet, having a low resistance, is utilized, though good transferred images can be obtained under the normal conditions.

SUMMARY OF THE INVENTION

To overcome the abovementioned drawbacks in conventional duplex color image forming apparatus, it is an object of the present invention to provide a duplex color image forming apparatus, in which a transferring operation of toner images is performed at a constant transferring efficiency, even if an ambient humidity is high, or a transfer sheet, having a low resistance characteristic, is utilized, and which makes it possible to form uniform and high-quality color images without generating any unevenness of the density like a stripped pattern.

Accordingly, to overcome the cited shortcomings, the abovementioned object of the present invention can be attained by duplex image forming apparatus described as follow.

(1) A duplex image forming apparatus, comprising: an image bearing member; a toner image forming section to form a toner image on the image bearing member; an intermediate transfer element, shaped like a belt and having a first surface onto which the toner image is transferred from the image bearing member and a second surface located opposite the first surface, to bear the toner image transferred from the image bearing member and to convey a transfer sheet while holding it on the first surface; a transfer sheet charging device, disposed opposite a charging position and facing the first surface of the intermediate transfer element, to apply a bias voltage onto the transfer sheet at the charging position, so that the transfer sheet adheres onto the first surface of the intermediate transfer element; a first transfer device, disposed opposite a first transferring position and facing the second surface of the intermediate transfer element, to transfer the toner image, formed on the image bearing member, onto the transfer sheet or the intermediate transfer element at the first transferring position; a second transfer device, disposed opposite a second transferring position and facing the first surface of the intermediate transfer element, to transfer the toner image, borne on the first surface of the intermediate transfer element, onto the transfer sheet at the second transferring position; and a control section to control a transfer current or a transfer voltage applied to the first transfer device, wherein, under a condition that a length of the transfer sheet in its conveyance direction is longer than a length of a conveyance path ranging from the charging position to the second transferring position, the control section changes the transfer current or the transfer voltage, corresponding to each of three states, including a first state in which a leading edge of the transfer sheet has not arrived at the second transferring position, a second state in which the leading edge of the transfer sheet has passed through the second transferring position while a trailing edge of the transfer sheet has not arrived at the charging position and a third state in which the trailing edge of the transfer sheet has passed through the charging position.

(2) The duplex image forming apparatus of item 1, wherein the control section changes an absolute value of the transfer current or the transfer voltage in the second state into a smaller absolute value than that of the transfer current or the transfer voltage applied to the first transfer device in the first state.

(3) The duplex image forming apparatus of item 1, wherein the control section changes an absolute value of the transfer current or the transfer voltage in the second state into a larger absolute value than that of the transfer current or the transfer voltage applied to the first transfer device in the third state.

(4) The duplex image forming apparatus of item 1, further comprising: a leading edge detecting device to detect a passage of the leading edge of the transfer sheet; and a trailing edge detecting device to detect a passage of the trailing edge of the transfer sheet, wherein the control section changes the transfer current or the transfer voltage based on signals detected by the leading edge detecting device and the trailing edge detecting device.

(5) The duplex image forming apparatus of item 4, wherein the leading edge detecting device and the trailing edge detecting device detect the passage of the leading edge of the transfer sheet and the passage of the trailing edge of the transfer sheet, respectively, by detecting a change of a charge current or a charge voltage of the transfer sheet charging device.

(6) The duplex image forming apparatus of item 1, further comprising: a detecting device to detect a electronic resistance of the transfer sheet, or to detect a humidity in the duplex image forming apparatus, wherein the control section changes the transfer current or the transfer voltage applied to the first transfer device, when the electronic resistance, detected by the detecting device, is lower than a predetermined resistance value, or when the humidity, detected by the detecting device, is higher than a predetermined humidity value, while the control section does not change the transfer current or the transfer voltage applied to the first transfer device, when the electronic resistance, detected by the detecting device, is higher than the predetermined resistance value, or when the humidity, detected by the detecting device, is lower than the predetermined humidity value.

(7) The duplex image forming apparatus of item 6, wherein the control section further changes the transfer current or the transfer voltage applied to the first transfer device in each of the three states, including the first state, the second state and the third state, corresponding to a detecting result of the detecting device.

(8) The duplex image forming apparatus of item 1, further comprising: a second image bearing member; and a second toner image forming section to form a second toner image on the second image bearing member, wherein the second toner image, formed on the second image bearing member, is transferred onto the first surface of the intermediate transfer element.

(9) A duplex image forming apparatus, comprising: an image bearing member; a toner image forming section to form a toner image on the image bearing member; an intermediate transfer element, shaped like a belt and having a first surface onto which the toner image is transferred from the image bearing member and a second surface located opposite the first surface, to bear the toner image transferred from the image bearing member and to convey a transfer sheet while holding it on the first surface; a transfer sheet charging device, disposed opposite a charging position and facing the first surface of the intermediate transfer element, to apply a bias voltage onto the transfer sheet at the charging position, so that the transfer sheet adheres onto the first surface of the intermediate transfer element; a first transfer device, disposed opposite a first transferring position and facing the second surface of the intermediate transfer element, to transfer the toner image, formed on the image bearing member, onto the transfer sheet or the intermediate transfer element at the first transferring position; a second transfer device, disposed opposite a second transferring position and facing the first surface of the intermediate transfer element, to transfer the toner image, borne on the first surface of the intermediate transfer element, onto the transfer sheet at the second transferring position; and a control section to control a transfer current or a transfer voltage applied to the first transfer device, wherein, under a condition that a length of the transfer sheet in its conveyance direction is longer than a length of a conveyance path ranging from the charging position or the second transferring position to the first transferring position, the control section changes the transfer current or the transfer voltage, corresponding to each of two states, including a first state in which the transfer sheet resides at both the first transferring position and at least one of the charging position or the second transferring position, and a second state in which the transfer sheet resides only at the first transferring position.

(10) The duplex image forming apparatus of item 9, wherein the control section changes an absolute value of the transfer current or the transfer voltage in the first state into a smaller absolute value than that of the transfer current or the transfer voltage applied to the first transfer device in the second state.

(11) The duplex image forming apparatus of item 9, further comprising: a leading edge detecting device to detect a passage of the leading edge of the transfer sheet, wherein the control section changes the transfer current or the transfer voltage, applied to the first transfer device, based on signals detected by the leading edge detecting device.

(12) The duplex image forming apparatus of item 11, wherein the leading edge detecting device detects the passage of the leading edge of the transfer sheet by detecting a change of a charge current or a charge voltage of the transfer sheet charging device.

(13) The duplex image forming apparatus of item 9, further comprising: a second image bearing member; and a second toner image forming section to form a second toner image on the second image bearing member, wherein the second toner image, formed on the second image bearing member, is transferred onto the first surface of the intermediate transfer element.

BRIEF DESCRIPTION OF THE DRAWINGS

Other objects and advantages of the present invention will become apparent upon reading the following detailed description and upon reference to the drawings in which:

FIG. 3(A) is a view showing a toner image forming condition when the reverse image formed on an image bearing member is transferred onto an intermediate transfer element;

FIG. 3(B) is a view showing a toner image forming condition when the obverse image is formed on the image bearing member in timed relationship with the reverse image on the intermediate transfer element;

FIG. 3(C) is a view showing the two-side image formation onto the transfer material.

DETAILED DESCRIPTION OF THE PREFERRED EMBODIMENT

Examples of the present invention will be described below. Incidentally, description in these columns does not limit technological scope of claims and meanings of technological terms of the present invention. Conclusive description hereinafter in examples of the present invention show the best mode in each example, and does not limit the meanings of technological terms and the technological scope of the present invention. Hereinafter, in the description of examples, the surface of the transfer material opposite to the image bearing member in the transfer area (upper surface) is defined as the obverse side, and the other surface of the transfer material, that is, the surface of the transfer material opposite to the intermediate transfer element (lower surface) is defined as the reverse side, and the image transferred onto the obverse side of the transfer material is defined as the obverse image, and the image transferred onto the reverse side is defined as the reverse image.

Figure 1:
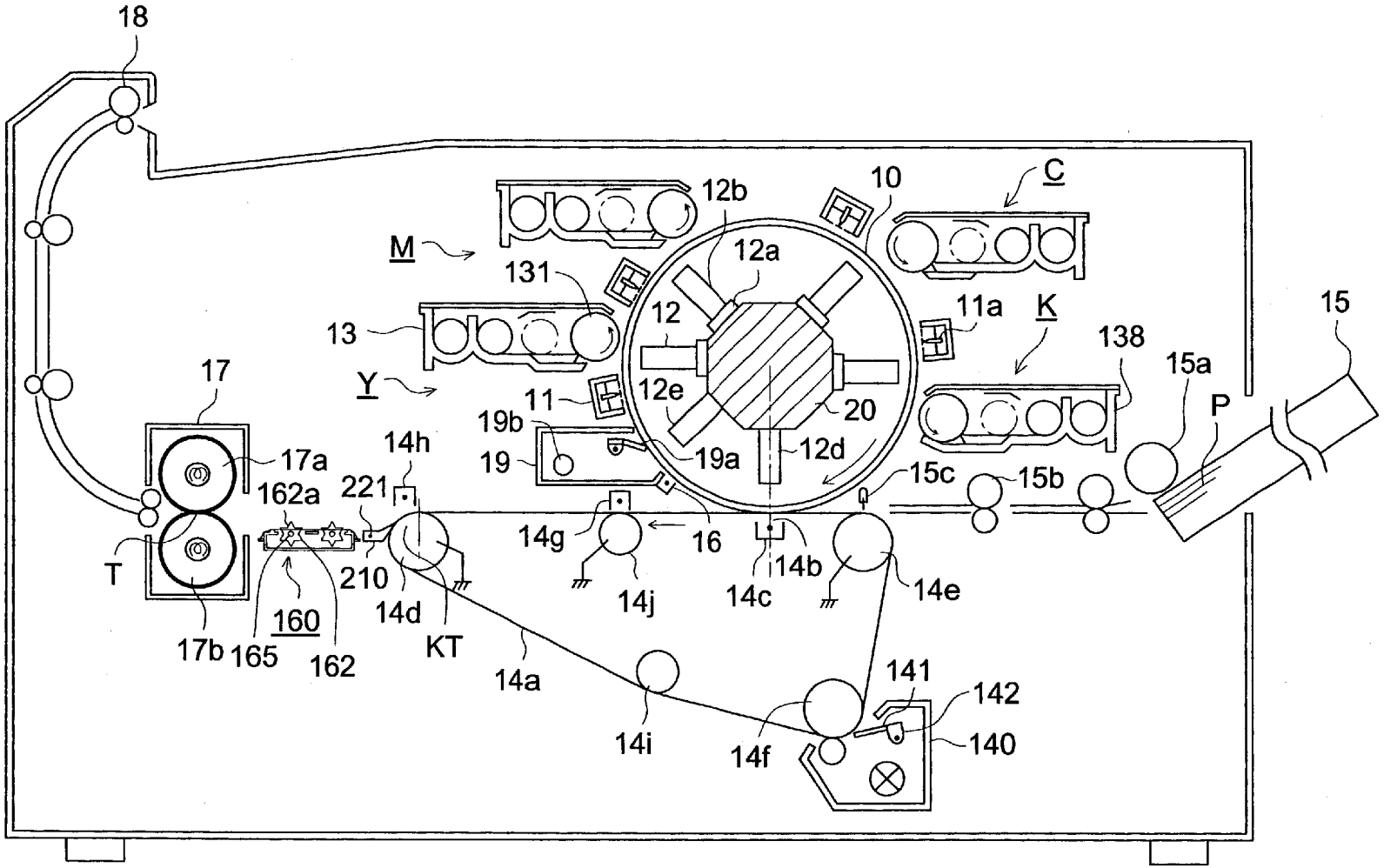
FIG. 1 shows a structural cross-sectional view of an example of image forming apparatus embodied in the present invention.
Figure 2:
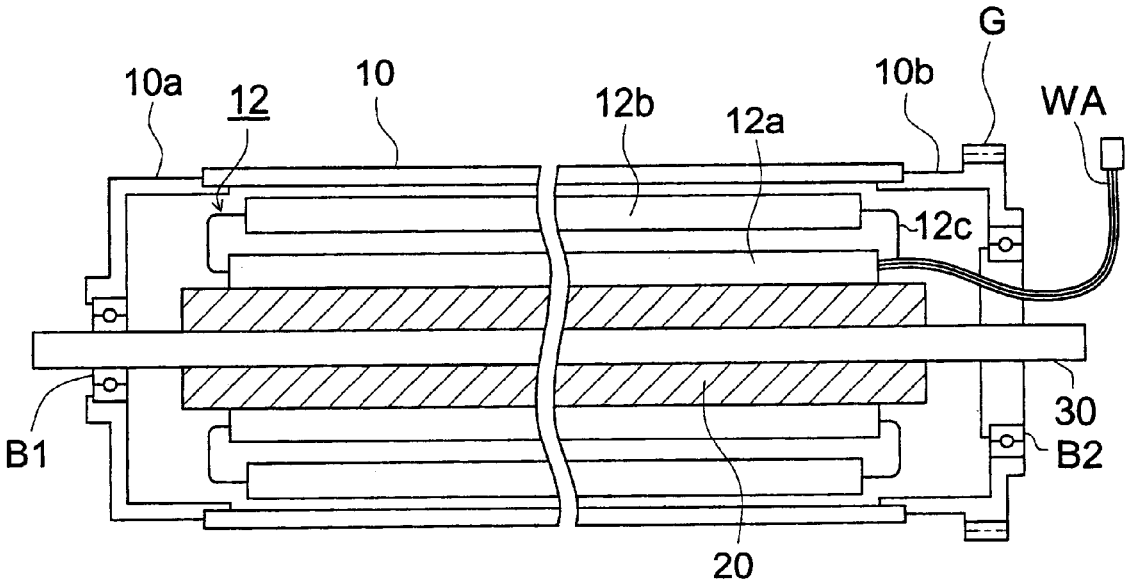
FIG. 2 shows a cross-sectional view of an image bearing member shown, in FIG. 1.

Referring to FIGS. 1 through 3, an image forming process and each mechanism of an example of an image forming apparatus used for a fixing apparatus according to the present invention will be described below. FIG. 1 is a structural sectional view of a color image forming apparatus showing an example of an image forming apparatus using a fixing apparatus according to the present invention; FIG. 2 is a cross sectional view of an image bearing member shown in FIG. 1; FIG. 3(A) is a view showing a toner image forming condition when the reverse image formed on an image bearing member is transferred onto an intermediate transfer element; FIG. 3(B) is a view showing a toner image forming condition when the obverse image is formed on the image bearing member in timed relationship with the reverse image on the intermediate transfer element; and FIG. 3(C) is a view showing the two-side image formation onto the transfer material.

In FIG. 1, numeral 10 is a photoreceptor drum serving as an image bearing member, numeral 11 is a scorotron charger serving as a charging means for each color, numeral 12 is an exposure optical system serving as an image writing means for each color, numeral 13 is a developing device serving as a developing means for each color, numeral 14*a* is an intermediate transfer belt serving as an intermediate transfer element, numeral 14*c* is a first transfer device serving as the first means for transferring a toner image formed on the image bearing member onto the intermediate transfer element or the obverse side of the transfer material, numeral 14*g* is a second transfer device serving as the second means for re-transferring a toner image borne on the intermediate transfer element onto the reverse side of the transfer material, numeral 15*c* is a paper charger serving as charging means for charging the transfer material, numeral 14*h* is a paper separation AC discharger serving as a transfer material separation means, numeral 160 is a conveyance section having a separation claw 210 serving as a claw member and a spur 162 serving as a spur member, and numeral 17 is a fixing apparatus serving as fixing means.

Photoreceptor drum 10 serving as the image bearing member has such a structure that, for example, a photoreceptor layer (also called photo-conductive layer) such as a transparent conductive layer, a-Si layer or organic photoreceptor layer (OPC), is formed on the outer periphery of a cylindrical base body formed of a transparent member such as optical glass or transparent acrylic resin, and is rotated clockwise at a line velocity within a range of, for instance, 80–400 mm/sec. (in this embodiment, setting at 280 mm/sec.), as shown by an arrow in FIG. 1, while the conductive layer is electrically grounded.

As shown in FIG. 2, outer sleeves of bearings B1, B2 are inserted into flange members 10*a*, 10*b*, which are disposed at both ends of photoreceptor drum 10 to support it, and drum axis member 30, fixed to the apparatus main-frame, is inserted into inner sleeves of bearings B1, B2 to rotatably support photoreceptor drum 10. Gear G, integrally formed on flange member 10*b*, is geared with a driving gear (not shown in the drawings) disposed in the apparatus main-frame to rotate photoreceptor drum 10 at constant velocity in a predetermined direction.

The image forming means, for forming a toner image on the image bearing member, includes scorotron charger 11 serving as a charging means for each color, exposure optical system 12 serving as an image writing means for each color, and developing device 13, serving as a developing means, which are combined into one set, and four sets of these means are provided for an image forming process for each color of yellow (Y), magenta (M), cyan (C) and black (k), and arranged in the order of Y, M, C, and K in the rotational direction of photoreceptor drum 10 as shown by an arrow in FIG. 1.

Scorotron charger 11, serving as a charging means for each color, has a control grid respectively kept at predetermined potential voltage, and discharging electrode 11*a* formed of, for example, a saw-toothed electrode, and is provided opposing to the photoreceptor layer of photoreceptor drum 10, and conducts a charging operation by corona discharging with the same polarity as that of toner (in the present example, negative charging), and applies uniform potential voltage onto photoreceptor drum 10. As for discharging electrode 11*a*, a wire electrode or a needle-shaped electrode may also be applicable.

Exposure optical system 12, serving as an image writing means for each color, is arranged inside photoreceptor drum 10 in such a manner that the exposure position on photoreceptor drum 10 is located at the downstream side in the rotational direction of photoreceptor drum 10 with respect to above-described scorotron charger 11 for each color. As shown in FIG. 2, each exposure optical system 12 is formed into an exposure unit structured by linear exposure element 12*a*, in which a plurality of LEDs (light emitting diode) as a light emitting element for image-wise exposure light (image writing light) are aligned array-like, wherein liner exposure element 12*a* is arranged in the primary scanning direction in parallel with drum shaft 30; and light converging optical transmitter 12*b* (trade name: Selfoc lens array) serving as an image focusing element; and lens holder 12*c* and the exposure unit is mounted onto holding member 20. Other than exposure optical system 12 for each color, transfer simultaneous exposure unit 12*d* and uniform exposure unit 12*e* are also mounted onto holding member 20, and integrally accommodated inside a light transmissive base body of photoreceptor drum 10. Exposure optical system 12 for each color imagewise-exposes the photoreceptor layer of photoreceptor drum 10 from the reverse surface, according to image data for each color read by a separately provided image reading apparatus and stored in a memory, and forms an electrostatic latent image on photoreceptor drum 10. As exposure elements 12*a*, an exposure element in which a plurality of light emitting elements such as FLs (fluorescent material emission elements), ELs (electro-luminescence elements), PLs (plasma discharge elements), etc., are aligned array-like, may be used other than LEDs. The wavelength of light emission of the image-wise exposure light emitting element is used normally in the range of 780–900 nm within which the transparency of Y, M, C toners is high, however, in the present invention, because image-wise exposure is carried out from the rear surface of the photoreceptor drum, the shorter wavelength of 400–700 nm, which has insufficient transparency for color toners, may be allowable. In addition, since the photoreceptor layer of photoreceptor drum 10 absorbs more than 80% of the light for image-wise exposure, it is possible to neglect the influences of a reflecting action and an absorbing action by the color toner residing on the surface of photoreceptor drum 10. Generally speaking, it is desirable that the developing order of color toner is in order of Y, M, C, K, when considering a toner image and a color mixing in developing devices 13. Incidentally, symbol WA indicates a lead wire from the light-emitting element (LED), which emits the light for image-wise exposure.

Developing devices 13, serving as a developing means for each color, have developing sleeves 131 formed of, for example, cylindrical non-magnetic stainless steel or aluminum material of 0.5–1 mm thickness, and of 15–25 mm outer diameter, developing sleeves being respectively rotated in the same direction as photoreceptor drum 10 at the developing position, while keeping a predetermined gap with respect to the peripheral surface of photoreceptor drum 10, and developing casings 138, in which one-component or two-component component developers for yellow(Y), magenta (M), cyan (C), and black (K) are respectively accommodated. Each developing device has a predetermined gap of, for example, 100–500 $\mu$m with respect to photoreceptor drum 10 with aid of a roller, not shown, and is kept in non-contact with the photoreceptor drum 10. When developing bias voltage in which DC voltage and AC voltage are superimposed, is applied onto developing sleeve 131, non-contact reversal development is carried out and a toner image is formed on photoreceptor drum 10.

Intermediate transfer belt 14*a*, serving as an intermediate transfer element, is an endless belt having the volume resistance of $10^8$–$10^{12}$ Ω·cm, preferably $10^{10}$–$10^{11}$ Ω·cm, and is a seamless belt having 2 layer construction consisting of 0.05–0.5 mm thick semi-conductive film base body on the outside of which 5–50 $\mu$m thick fluorine coating is preferably conducted as a toner filming prevention layer, wherein the semi-conductive film base body is formed by dispersing the conductive material in engineering plastics such as modified polyimide, thermo-hardened polyimide, ethylene tetra fluoroethylene copolymer, polyvinylidene fluoride, nylon alloy, etc. As a base body of intermediate transfer belt 14*a*, in addition to the above, 0.3–2.0 mm thick semi-conductive rubber belt formed by dispersing conductive material in silicon rubber, or urethane rubber, may also be used. Intermediate transfer belt 14*a* is stretched by being respectively inscribed by a driving roller 14*d*, electrically grounding roller 14*j*, driven roller 14*e*, guide roller 14*f* and tension roller 14*i*, each of which is a roller member, and is rotated counterclockwise as shown by an arrow in FIG. 1. Guide roller 14*f*, driven roller 14*e*, electrically grounding roller 14*j*, driving roller 14*d* are rotated at their fixed positions, and tension roller 14*i* is movably supported with aid of elastic force of a spring (not shown in the drawings) or the like, and is rotated. Driving roller 14*d* is rotated by the drive of a driving motor (not shown in the drawings) and drives intermediate transfer belt 14*a* for rotation. Electrically grounding roller 14*j*, driven roller 14*e*, guide roller 14*f* and tension roller 14*i* are driven by the rotation of intermediate transfer belt 14*a*. The slack of rotating intermediate transfer belt 14*a* is strained by tension roller 14*i*. Recording sheet P is supplied to the position, at which intermediate transfer belt 14*a* is stretched by driven roller 14*e*, and conveyed by intermediate transfer belt 14*a*. Recording sheet P is separated from intermediate transfer belt 14*a* at curvature portion KT of the end portion of belt 14*a* stretched by driving roller 14*d*, on the side of fixing apparatus 17.

First transfer device 14*c*, serving as the first means for transferring a toner image onto the intermediate transfer member or the obverse side of the transfer sheet, is a corona discharger provided opposite to photoreceptor drum 10 with intermediate transfer belt 14*a* between them, and transfer area 14*b* is formed between intermediate transfer belt 14*a* and photoreceptor drum 10. DC voltage having the polarity reverse to that of toner (in the present example, positive polarity) is applied onto first transfer device 14*c*, and a toner image on photoreceptor drum 10 is transferred onto intermediate transfer belt 14*a* or the obverse side of recording sheet P, serving as a transfer material.

Second transfer device 14*g*, serving as the second means for re-transferring a toner image borne on the intermediate transfer member onto the reverse side of the transfer sheet, is preferably structured by a corona discharger, and provided opposite conductive grounded roller 14*j*, which is located between first transfer device 14*c* and driving roller 14*d*, with putting intermediate transfer belt 14*a* between them, and DC voltage having the polarity reverse to that of toner (in the present example, positive polarity) is applied onto transfer device 14*g*, and a toner image on intermediate transfer belt 14*a* is transferred onto the reverse side of recording sheet P.

Paper charger 15*c*, serving as a transfer material charging means, is preferably structured by a sawtooth electrode or a corona discharger, and is provided opposite driven roller 14*e* with putting intermediate transfer belt 14*a* between them, and DC voltage with the same polarity as that of toner (in the present example, negative polarity) is applied onto paper charger 15*c*, and recording sheet P is charged thereby and attracted onto intermediate transfer belt 14*a*. As paper charger 15*c*, other than a sawtooth electrode or the corona discharger, a paper charging brush which can be brought into contact with and contact-released from intermediate transfer belt 14*a*, or a paper charging roller may be used.

Paper separation AC discharger 14*h*, serving as a transfer material separation means, is preferably structured by a corona discharger, and provided opposite conductive driving roller 14*d*, being electrically grounded, with putting intermediate transfer belt 14*a* between them, at the end portion of intermediate transfer belt 14*a* on the side of fixing apparatus 17. AC voltage on which DC voltage, having the same polarity as that of the DC voltage applied to second transfer device 14*g* or the reverse polarity of it, is superimposed, is applied to paper separation AC discharger 14*h*, in order to discharge recording sheet P conveyed by the intermediate transfer belt 14*a* to separated it from intermediate transfer belt 14*a*.

Conveyance section 160 has separation claw 210, serving as a claw member, and spur 162, serving as a spur member, and is provided between curvature portion KT at the end portion of intermediate transfer belt 14*a* and the fixing apparatus 17. Conveyance section 160 prevents the following disadvantages due to the heat from fixing apparatus 17: intermediate transfer belt 14*a* is deformed; the toner image carried on intermediate transfer belt 14*a* is fused a little, thereby, transferring becomes difficult; or toner fixedly adheres onto intermediate transfer belt 14*a*.

Separation claw 210, serving as a claw member, is in proximity to curvature portion KT of intermediate transfer belt 14*a*, and is fixedly provided on support shaft 221 with a predetermined gap, preferably 0.1–2.0 mm gap, to intermediate transfer belt 14*a*, and when recording sheet P is separated from intermediate transfer belt 14*a*, the leading edge portion of recording sheet P which is going to be conveyed while being bent to intermediate transfer belt 14*a*, is brought into contact with separation claw 210, thereby the separation of recording sheet P is helped.

Spur 162, serving as a spur member, has a plurality of protrusions 162*a* on the peripheral surface, and is rotatably provided around rotatable supporting shaft 163. Spur 162 guides the reverse side of recording sheet P for conveyance, thereby, prevents the reverse side toner image of recording sheet P having toner images on two-side thereof, from being disturbed, and stably conveys recording sheet P to fixing apparatus 17 while the entry direction of recording sheet P to fixing apparatus 17 is made constant.

Separation claw 210 and spurs 162 are disposed opposite photoreceptor drum 10 with respect to the transfer sheet conveying surface on intermediate transfer belt 14*a* or its extended surface. It is also possible to dispose spurs 162, serving as a spur member, at both sides of the transfer sheet conveying surface and its extended surface.

Fixing apparatus 17, serving as a fixing means, which is comprised of two roller-shaped fixing members, namely, first fixing member 17*a* having a heater inside and second fixing member 17*b*, fixes a toner image onto recording sheet P, which is nipped and conveyed by/through nip portion T formed between first fixing member 17*a* and second fixing member 17*b*, by applying heat and pressure at nip portion T. A high resistance layer is provided on the surface of both first fixing member 17*a* and second fixing member 17*b* to apply a bias voltage to them.

Next, an image forming process will be described.

When image recording is stated, photoreceptor drum 10 is rotated clockwise as shown by an arrow in FIG. 1 by the start of a photoreceptor driving motor, not shown, and simultaneously, application of potential voltage onto photoreceptor drum 10 is started by charging action of the scorotron charger 11 of yellow (Y).

After the potential voltage is applied onto photoreceptor drum 10, image writing by an electric signal corresponding to the first color signal, that is, Y image data is started by Y exposure optical system 12, and an electrostatic latent image corresponding to a Y image of the document image is formed on the surface of photoreceptor drum 10.

The latent image is reversal-developed under the non-contact condition by Y developing device 13, and a toner image of yellow (Y) is formed on photoreceptor drum 10.

Next, potential voltage is applied onto photoreceptor drum 10 from above the Y toner image by the charging action of magenta (M) scorotron charger 11, and image writing by an electric signal corresponding to the second color signal, that is, M image data is conducted by M exposure optical system 12, and a toner image of magenta (M) is formed on the toner image of yellow (Y) by superimposition, by non-contact reversal development by M developing device 13.

In the same process, by cyan (C) scorotron charger 11, C exposure optical system 12 and C developing device 13, a toner image of cyan (C) corresponding to the third color signal is formed on the above toner images by superimposition, and further, by black (K) scorotron charger 11, K exposure optical system 12 and K developing device 13, a toner image of black (K) corresponding to the fourth color signal is successively superimposed and formed thereon, and thus, superimposed color toner images of four colors of yellow(Y), magenta (M), cyan (C) and black (K) are formed on the peripheral surface of photoreceptor drum 10 during its one rotation (toner image forming means).

The image writing onto the photoreceptor layer of photoreceptor drum 10 by exposure optical systems 12 of Y, M, C and K is conducted from the inside of the drum through the above-described light transmissive base body. Accordingly, the image writing corresponding to the second, third and fourth color signals is conducted without any influence due to previously formed toner images, and the electrostatic latent image with the same quality as that of the image corresponding to the first color signal can be formed.

The superimposed color toner image, which becomes a reverse side image, formed on photoreceptor drum 10, serving as an image bearing member, by the above image forming process, is collectively transferred onto intermediate transfer belt 14*a* serving as a intermediate transfer member, by first transfer device 14*c* in transfer area 14*b*, (FIG. 3(A)). In this case, uniform exposure may be conducted by transfer simultaneous exposure device 12*d* provided inside photoreceptor drum 10 so that excellent transferring may be conducted.

Toner, remaining on the peripheral surface of photoreceptor drum 10 after the transferring operation, is discharged by photoreceptor drum AC discharger 16, then, comes to cleaning device 19, serving as an image bearing member cleaning means, and is cleaned by cleaning blade 19*a* made of a rubber material and being in contact with photoreceptor drum 10, after that, the toner is collected in a waste toner container, not shown, by screw 19*b*. Further, the hysteresis of the previous image formation remained on the surface of photoreceptor drum 10 is erased by the uniform exposing operation of uniform exposure device 12*e* by means of, for example, light emitting diodes, proceeding to the charging operation.

In the manner as described above, after the superimposed color toner image, which is the reverse side image, has been formed on intermediate transfer belt 14*a*, in the same manner as the above-described color image forming process, a superimposed color toner image, which is the obverse side image, is successively formed on photoreceptor drum 10 (FIG. 3(B)). In this case, image data is changed so that the obverse side image formed on photoreceptor drum 10 is a mirror image with respect to the reverse side image previously formed on photoreceptor drum 10.

Following to the obverse side image formation onto photoreceptor drum 10, recording sheet P, serving as a transfer material, is sent from sheet feed cassette 15, serving as a transfer material accommodation means, by means of sending-roller 15*a*, and conveyed to timing roller 15*b* serving as a transfer material sending means, and the color toner image of the obverse side image formed on photoreceptor drum 10 is sent to the transfer area 14*b*, synchronized with the color toner image of the reverse side image carried on intermediate transfer belt 14*a*, by means of timing roller 15*b*. In this case, recording sheet P is charged to the same polarity as that of toner by the paper charger 15*c*, serving as a transfer material charging means and disposed on the obverse side of recording sheet P, attracted onto intermediate transfer belt 14*a*, and is sent to the transfer area 14*b*. When recording sheet P is paper-charged to the same polarity as that of toner, recording sheet P is prevented from being attracted to the toner image on intermediate transfer belt 14*a* or the toner image on photoreceptor drum 10, resulting in prevention of toner image disturbance.

In transfer area 14*b*, the obverse side image on photoreceptor drum 10 is collectively transferred on the obverse side of recording sheet P by transfer device 14*c*, onto which the voltage with the reverse polarity to that of toner (in the present example, positive polarity) is applied. In this case, the reverse side image on intermediate transfer belt 14*a* is not transferred onto recording sheet P and exists on intermediate transfer belt 14*a*. In this case, uniform exposure may be conducted by transfer simultaneous exposure device 12*d*, which employs, for example, light emitting diodes disposed inside photoreceptor drum 10 opposite to transfer area 14*b*, so that excellent transferring may be conducted.

Recording sheet P, onto the obverse side of which the color toner image is transferred, is conveyed to second transfer device 14*g*, onto which the voltage of the reverse polarity to that of toner (in the present example, positive polarity) is applied, and the reverse side image on the surface of intermediate transfer belt 14*a* is collectively transferred onto the reverse side of recording sheet P by second transfer device 14*g* (FIG. 3(C)).

Recording sheet P, on both sides of which the color toner images are formed, is separated from intermediate transfer belt 14*a* by the curvature of curvature portion KT of intermediate transfer belt 14*a*, by the discharging operation of paper separation AC discharger 14*h*, serving as a transfer material separation means, provided at the end portion of intermediate transfer belt 14*a*, and by separation claw 210 provided on conveyance section 160 with a predetermined gap to intermediate transfer belt 14*a*, and then, conveyed to fixing apparatus 17, serving as a fixing means, through the spur 162 provided on the conveyance section 160. In fixing apparatus 17, recording sheet P is conveyed into nip section T formed between first fixing roller 17*a* and second fixing roller 17*b* to fix the toner images onto recording sheet P by applying heat and pressure to it at nip section T. The obverse and reverse sides of recording sheet P on which two-sided images are recorded, are reversed, and the recording sheet P is sent and delivered onto a tray outside the apparatus by sheet delivery roller 18.

The toner, remaining on the surface of intermediate transfer belt 14*a* after transferring operation, is cleaned by intermediate transfer element cleaning device 140, serving as an intermediate transfer element cleaning means, disposed opposite driven roller 14*e* with putting the intermediate transfer belt 14*a* between them, and having intermediate transfer element cleaning blade 141, wherein cleaning blade 141 uses support shaft 142 as a fulcrum of rotation and can be in contact with or contact-released from intermediate transfer belt 14*a*.

Further, the toner, remaining on the surface of photoreceptor drum 10 after transferring operation, is discharged by photoreceptor drum AC discharger 16, and then, the hysteresis of the previous image formation remained on the surface of photoreceptor drum 10 is erased by means of uniform exposure device 12*e*, proceeding to the charging operation, and photoreceptor drum 10 enters the next image formation cycle.

When the above-described method is applied, the superimposed color toner images are collectively transferred, thereby, color doubling of the color image, toner scattering and rubbing on intermediate transfer belt 14*a* hardly occur, and the excellent two-sided color image formation can be carried out with smaller image deterioration.

In the duplex image forming apparatus embodied in the present invention, either sensor S1, for measuring an ambient temperature and humidity in the apparatus, or sensor S2, for measuring an electronic-resistance of the transfer sheet, is provided to control the values of the bias voltage or the electronic current, which are applied to paper-charger 15*c*, first transfer device 14*c* and second transfer device 14*g*, based on the measurement results of either sensor S1 or sensor S2. Further, in the apparatus embodied in the present invention, control actions are performed so as to change the value of the bias voltage or current applied to first transfer device 14*c*, when the trailing edge of the transfer sheet passes through paper-charger 15*c*, or when the leading edge of the transfer sheet arrives at second transfer device 14*g*. Still further, in the embodiment of the present invention, sensor S3, for detecting a fluctuation of the electronic current flowing between paper-charger 15*c* for charging the transfer sheet and a power source for applying the bias voltage to paper-charger 15*c*, is provided to detect a time when the leading edge or the trailing edge of the transfer sheet passes through paper-charger 15*c*, by detecting a time of fluctuation of the electronic current by means of sensor S3. The control section calculates the time when the leading edge or the trailing edge of the transfer sheet passes through first transfer device 14*c* or second transfer device 14*g*, deriving from the time detected by sensor S3, and performs control actions so as to change the value of the bias voltage or current applied to first transfer device 14*c*.

Figure 4:
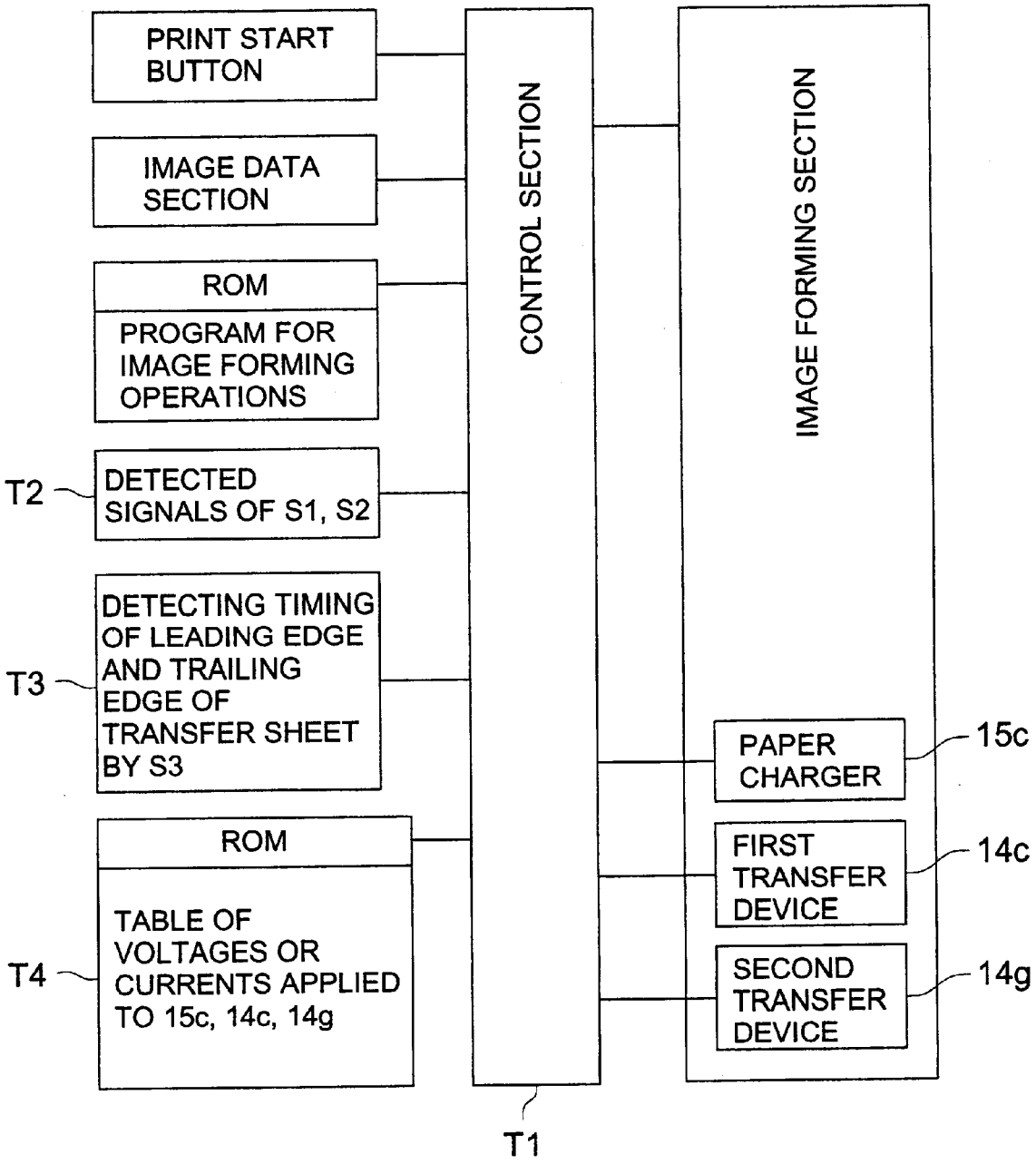
FIG. 4 shows a block-diagram of a control system, embodied in the present invention, for controlling the values of the bias voltage or the electronic current

FIG. 4 shows a block-diagram of a control system, embodied in the present invention, for controlling the values of the bias voltage or the electronic current, which are applied to paper-charger 15*c*, first transfer device 14*c* and second transfer device 14*g*. When the power source is turned ON and the apparatus enters in a warming-up state, the control section determines whether the present environment falls under a category of either a high humidity, a normal humidity or a low humidity, or either a category of a high resistance, a mediate resistance or a low resistance, based on the ambient humidity or the resistance of the transfer sheet, detected by sensor S1 or sensor S2 (T2), and, corresponding to the determined category, the control section retrieves an appropriate table (corresponding to Tables 1–3, described later) of applied voltages or currents to be applied to paper-charger 15*c*, first transfer device 14*c* and second transfer device 14*g* from the ROM memory (T4). Further, the control section controls values of bias voltages or currents to be applied to paper-charger 15*c*, first transfer device 14*c* and second transfer device 14*g* during image forming operations, based on the passing time, when the leading edge or the trailing edge of the transfer sheet passes through paper-charger 15*c*, detected by sensor S3 (T1).

In the following, the present invention will be detailed, referring to Embodiments 1–3. The following conditions are common through Embodiments 1–3.

The line velocity of photoreceptor drum 10=280 mm/sec.

The line velocity of intermediate transfer belt 14*a* =280 mm/sec.

The sawtooth-type electrode is employed for paper-charger 15*c*.

The corona charger, having a width of 16 mm, is employed for first transfer device 14*c*.

The corona charger, having a width of 16 mm, is employed for second transfer device 14*c*.

The resistance of intermediate transfer belt 14*a* =order of $10^{10}$ Ω·cm (when 20° C., 50% RH)

The resistance of the transfer sheet=order of $10^{11}$ Ω·cm (when 20° C., 50% RH)

Embodiment 1

Figure 5:
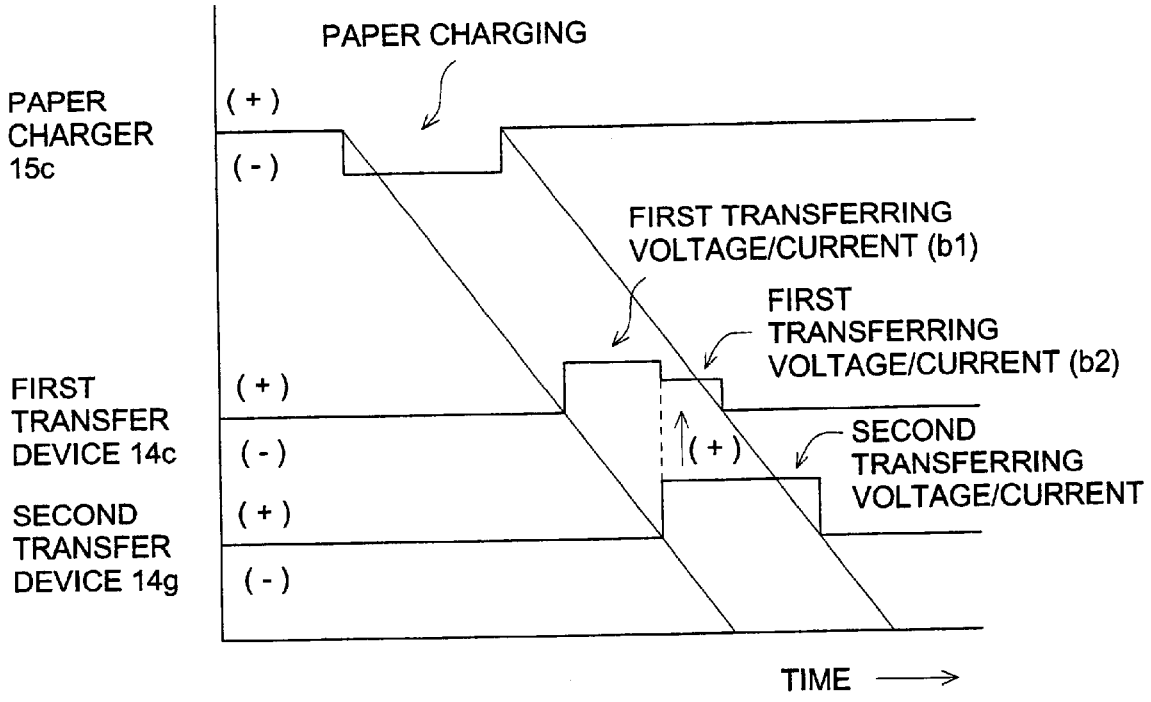
FIG. 5 shows a time-chart of controlling actions in the first embodiment.

In the Embodiment 1, the length of the transfer sheet in its conveyance direction is longer than the length of the conveyance path ranging from the first transferring position of first transfer device 14*c* to the second transferring position of second transfer device 14*g*, and the ambient humidity or the resistance of the transfer sheet, detected by sensor S1 or sensor S2, falls under the category of the high humidity or the category of the low resistance. In this case, the control section performs controlling actions, so that the value of the transfer current or the transfer voltage (the bias voltage), applied to first transfer device 14*c* for transferring a toner image on photoreceptor drum 10 to the obverse side of the transfer sheet conveyed on intermediate transfer belt 14*a* before the leading edge of the transfer sheet arrives at the second transferring position, changes into the different value after the leading edge of the transfer sheet passes through the second transferring position, and the absolute value of the transfer current or the transfer voltage (first transferring voltage/current b2), applied to first transfer device 14*c* after the leading edge of the transfer sheet passes through the second transferring position, decreases into a smaller value than the absolute value of the transfer current or the transfer voltage (the first transferring voltage/current b1), applied to first transfer device 14*c* before the leading edge of the transfer sheet arrives at the second transferring position. FIG. 5 shows a time-chart of the abovementioned controlling actions, indicating a time relationship between the paper-charging operation performed by paper-charger 15*c*, the first transferring operation for transferring a toner image onto the transfer sheet by means of first transfer device 14*c* and the second transferring operation performed by second. transfer device 14*g*.

Incidentally, in the first transferring voltage/current b2 in which first transfer device 14*c* performs the transferring operation, under the condition that the resistance of the transfer sheet is low, since the positive charge can flow into the first transferring position from second transfer device 14*g*, the first transferring efficiency increases, even if the first transferring voltage or the first transferring current is set at a low value. In the Embodiment 1, the control section controls the value of the first transferring voltage or the first transferring current so that the density of the image transferred in first transferring voltage/current b2 is the same as that transferred in first transferring voltage/current b1, by setting the first transferring condition of first transferring voltage/current b2 lower than that of first transferring voltage/current b1.

On the other hand, when the ambient humidity or the resistance of the transfer sheet, detected by sensor S1 or sensor S2, falls under the category of the normal humidity or the low humidity or the category of the mediate resistance or the high resistance, the control section does not control the value of the transferring voltage or the transferring current of first transfer device 14*c* when the transfer sheet passes. It is desirable, however, that the set-value of the transferring voltage or the transferring current of first transfer device 14*c* is changed, corresponding to the ambient humidity or the resistance of the transfer sheet, detected by sensor S1 or sensor S2.

An example of the concrete data in the Embodiment 1 is indicated in the following.

A4 size, sending sideway (paper length=210)

(length from the paper-charging position to the first transferring position) >210

(length from the first transferring position to the second transferring position) <210

TABLE 1

| | High humidity | Normal humidity | Low humidity |
|---|---|---|---|
| Paper charge | - 4.0 kV | - 4.0 kV | - 4.0 kV |
| First transfer (a) | + 4.3 kV | + 4.1 kV | + 4.0 kV |
| First transfer (b1) | + 4.6 kV | + 5.1 kV | + 5.0 kV |
| First transfer (b2) | + 4.4 kV | + 5.1 kV | + 5.0 kV |
| Second transfer | + 6.0 kV | + 5.5 kV | + 5.3 kV |

In Table 1, the line of first transferring (a) indicates the transfer voltages applied to first transfer device 14*c*, when a toner image, formed on photoreceptor drum 10, is transferred onto intermediate transfer belt 14*a*.

According to the controlling actions performed in the Embodiment 1, it becomes possible to constantly form good toner images on the transfer sheet, without being influenced by ambient conditions and fluctuations of the resistance of the transfer sheet, and without generating any transferring unevenness like a stripped pattern.

Embodiment 2

Figure 6:
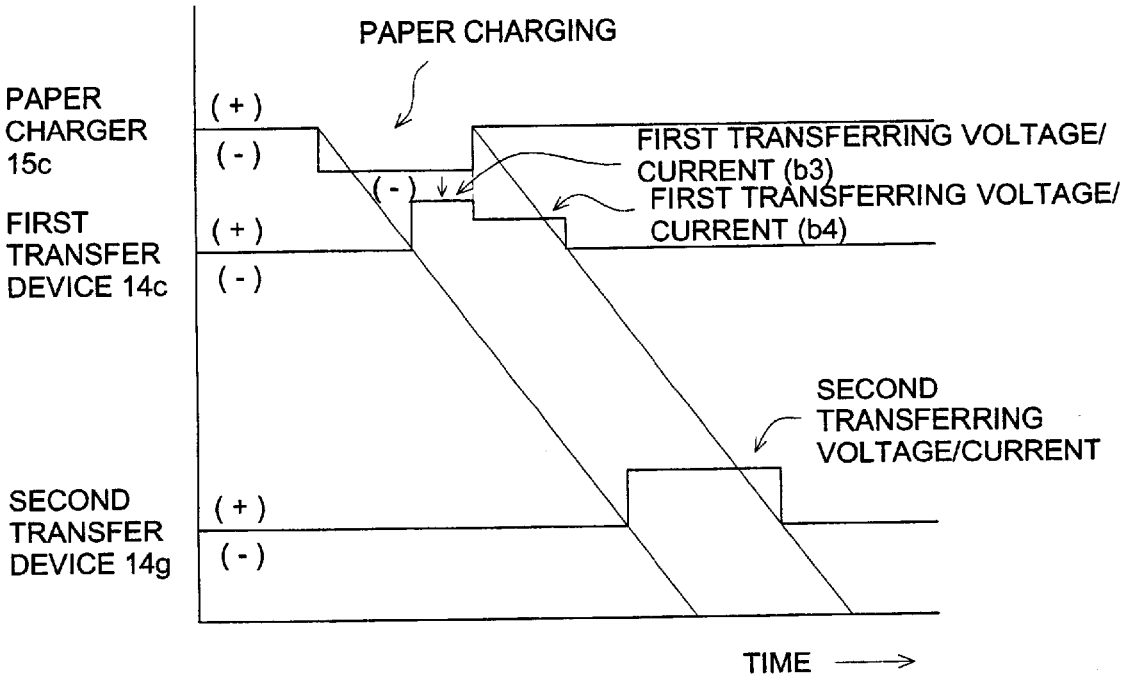
FIG. 6 shows a time-chart of controlling actions in the second embodiment.

In the Embodiment 2, the length of the transfer sheet in its conveyance direction is longer than the length of the conveyance path ranging from the charging position of paper-charger 15*c* to the first transferring position of first transfer device 14*c*, and the ambient humidity or the resistance of the transfer sheet, detected by sensor S1 or sensor S2, falls under the category of the high humidity or the category of the low resistance. In this case, the control section performs controlling actions, so that the value of the transfer current or the transfer voltage (the bias voltage), applied to first transfer device 14*c* for transferring a toner image on photoreceptor drum 10 to the obverse side of the transfer sheet conveyed on intermediate transfer belt 14*a* before the trailing edge of the transfer sheet arrives at the charging position, changes into the different value after the trailing edge of the transfer sheet passes through the charging position, and the absolute value of the transfer current or the transfer voltage (first transferring voltage/current b4), applied to first transfer device 14*c* after the trailing edge of the transfer sheet passes through the charging position, decreases into a smaller value than the absolute value of the transfer current or the transfer voltage (first transferring voltage/current b3), applied to first transfer device 14*c* before the trailing edge of the transfer sheet arrives at the charging position. FIG. 6 shows a time-chart of the abovementioned controlling actions, indicating a time relationship between the paper-charger operation performed by paper-charger 15*c*, the first transferring operation for transferring a toner image onto the transfer sheet by means of first transfer device 14*c* and the second transferring operation performed by second transfer device 14*g*.

Incidentally, in first transferring voltage/current b4 in which first transfer device 14*c* performs the transferring operation, under the condition that the resistance of the transfer sheet is low, since no negative charge can flow into the first transferring position from paper-charger 15*c*, the first transferring current becomes excessive if the first transferring condition of first transferring voltage/current b3 is maintained. Accordingly, in the Embodiment 2, the control section controls the value of the first transferring voltage or the first transferring current so that the density of the image transferred in first transferring voltage/current b4 is the same as that transferred in first transferring voltage/current b3, by setting the first transferring condition of first transferring voltage/current b4 lower than that of first transferring voltage/current b3.

On the other hand, when the ambient humidity or the resistance of the transfer sheet, detected by sensor S1 or sensor S2, falls under the category of the normal humidity or the low humidity or the category of the mediate resistance or the high resistance, the control section does not control the value of the transferring voltage or the transferring current of first transfer device 14*c* when the transfer sheet passes. It is desirable, however, that the set-value of the transferring voltage or the transferring current of first transfer device 14*c* is changed, corresponding to the ambient humidity or the resistance of the transfer sheet, detected by sensor S1 or sensor S2.

An example of the concrete data in the Embodiment 2 is indicated in the following.

A4 size, sending sideway (paper length=210)

(length from the paper-charging position to the first transferring position) >210

(length from the first transferring position to the second transferring position) <210

TABLE 2

| | High humidity | Normal humidity | Low humidity |
|---|---|---|---|
| Paper charge | - 4.0 kV | - 4.0 kV | - 4.0 kV |
| First transfer (a) | + 4.3 kV | + 4.1 kV | + 4.0 kV |
| First transfer (b3) | + 5.4 kV | + 5.1 kV | + 5.0 kV |
| First transfer (b4) | + 4.6 kV | + 5.1 kV | + 5.0 kV |
| Second transfer | + 6.0 kV | + 5.5 kV | + 5.3 kV |

According to the controlling actions performed in the Embodiment 2, it becomes possible to constantly form good toner images on the transfer sheet, without being influenced by ambient conditions and fluctuations of the resistance of the transfer sheet, and without generating any transferring unevenness like a stripped pattern.

Embodiment 3

Figure 7:
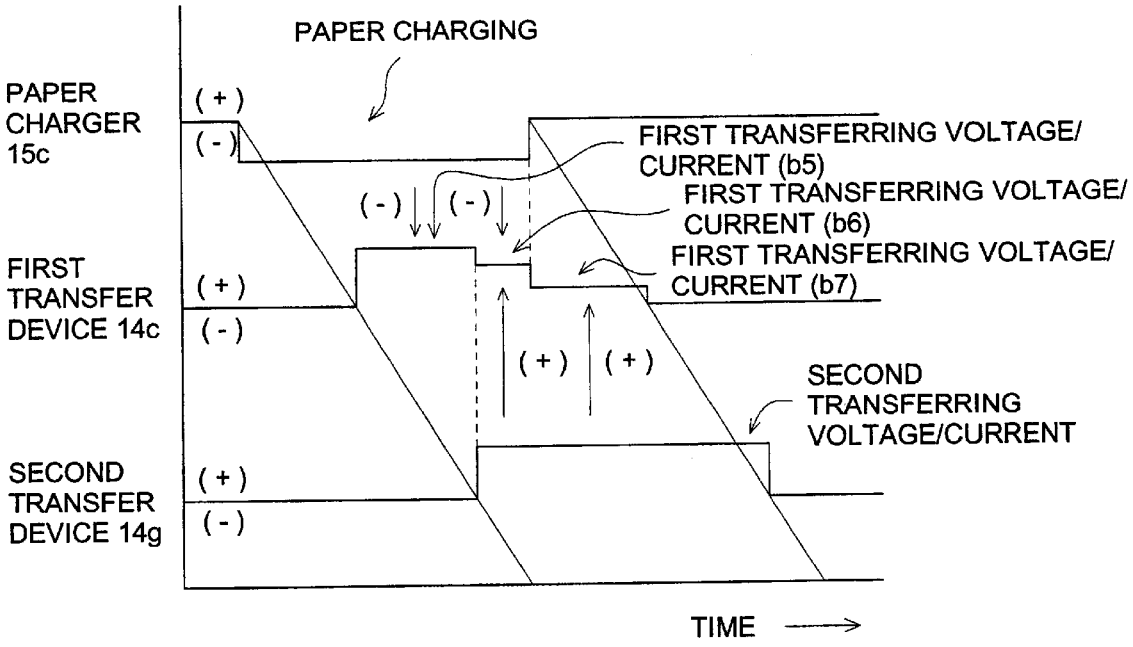
FIG. 7 shows a time-chart of controlling actions in the third embodiment.

In the Embodiment 3, the length of the transfer sheet in its conveyance direction is longer than the length of the conveyance path ranging from the charging position of paper-charger 15*c* to the second transferring position of second transfer device 14*c*, and the ambient humidity or the resistance of the transfer sheet, detected by sensor S1 or sensor S2, falls under the category of the high humidity or the category of the low resistance. In this case, the control section performs controlling actions in a manner such that the value of the transfer current or the transfer voltage (the bias voltage), applied to first transfer device 14*c* for transferring a toner image on photoreceptor drum 10 to the obverse side of the transfer sheet conveyed on intermediate transfer belt 14*a* before the leading edge of the transfer sheet arrives at the second transferring position, changes into the different value after the leading edge of the transfer sheet passes through the second transferring position and before the trailing edge of the transfer sheet arrives at the charging position, and further changes into the different value after the trailing edge of the transfer sheet passes through the charging position, namely, the absolute value of the transfer current or the transfer voltage (first transferring voltage/current b6), applied to first transfer device 14*c* after the leading edge of the transfer sheet passes through the second transferring position and before the trailing edge of the transfer sheet arrives at the charging position, decreases into a smaller value than the absolute value of the transfer current or the transfer voltage (first transferring voltage/current b5), applied to first transfer device 14*c* before the leading edge of the transfer sheet arrives at the second transferring position and further decreases into a smaller value than the absolute value of the transfer current or the transfer voltage (first transferring voltage/current b7), applied to first transfer device 14*c* after the trailing edge of the transfer sheet passes through the charging position. FIG. 7 shows a time-chart of the abovementioned controlling actions, indicating a time relationship between the paper-charging operation performed by paper-charger 15*c*, the first transferring operation for transferring a toner image onto the transfer sheet by means of first transfer device 14*c* and the second transferring operation performed by second transfer device l4*g*.

Incidentally, in the first transferring voltage/current b5, under the condition that the resistance of the transfer sheet is low, since the negative charge can flow into the first transferring position from paper-charger 15*c*, the transferring condition should be set at a high level in a positive direction. In the first transferring voltage/current b6, since the negative charge can flow into the first transferring position from paper-charger 15*c* and the positive charge can flow into the first transferring position from the second transfer device 14*g*, the transferring condition should be set at a lower level than that in the first transferring voltage/current b5. Further, in the first transferring voltage/current b7, since no negative charge can flow into the first transferring position from paper-charger 15*c*, the transferring condition should be set at a lower level than that in the first transferring voltage/current b6. In the Embodiment 3, the control section controls the value of the first transferring voltage or the first transferring current so that the density of the image transferred in first transferring voltage/current b5 is the same as that transferred in each of first transferring voltage/currents b6 and b7, by setting the first transferring condition as mentioned above.

On the other hand, when the ambient humidity or the resistance of the transfer sheet, detected by sensor S1 or sensor S2, falls under the category of the normal humidity or the low humidity or the category of the mediate resistance or the high resistance, the control section does not control the value of the transferring voltage or the transferring current of first transfer device 14*c* when the transfer sheet passes. It is desirable, however, that the set-value of the transferring voltage or the transferring current of first transfer device 14*c* is changed, corresponding to the ambient humidity or the resistance of the transfer sheet, detected by sensor S1 or sensor S2.

An example of the concrete data in the Embodiment 3 is indicated in the following.

A3 size, sending lengthwise (paper length=420)

(length from the first transferring position to the second transferring position) <420

TABLE 3

| | High humidity | Normal humidity | Low humidity |
|---|---|---|---|
| Paper charge | - 4.0 kV | - 4.0 kV | - 4.0 kV |
| First transfer (a) | + 4.3 kV | + 4.1 kV | + 4.0 kV |
| First transfer (b5) | + 5.4 kV | + 5.1 kV | + 5.0 kV |
| First transfer (b6) | + 5.2 kV | + 5.1 kV | + 5.0 kV |
| First transfer (b7) | + 4.4 kV | + 5.1 kV | + 5.0 kV |
| Second transfer | + 6.0 kV | + 5.5 kV | + 5.3 kV |

According to the controlling actions performed in the Embodiment 3, it becomes possible to constantly form good toner images on the transfer sheet, without being influenced by ambient conditions and fluctuations of the resistance of the transfer sheet, and without generating any transferring unevenness like a stripped pattern.

Next, another embodiment of the present invention will be detailed in the following. The duplex image forming apparatus, embodied in the present invention, comprises two image-bearing members, on one of which a toner image of the reverse side is formed, while on another of which a toner image of the obverse side is formed, to form toner images on both sides of the transfer sheet through the intermediate transfer member. The configuration and the image forming process of the duplex image forming apparatus will be detailed in the following, referring to FIGS. 8–10.

Incidentally, the members, having the same functions as those in the previous embodiment, will be indicated by the same notations.

Figure 8:
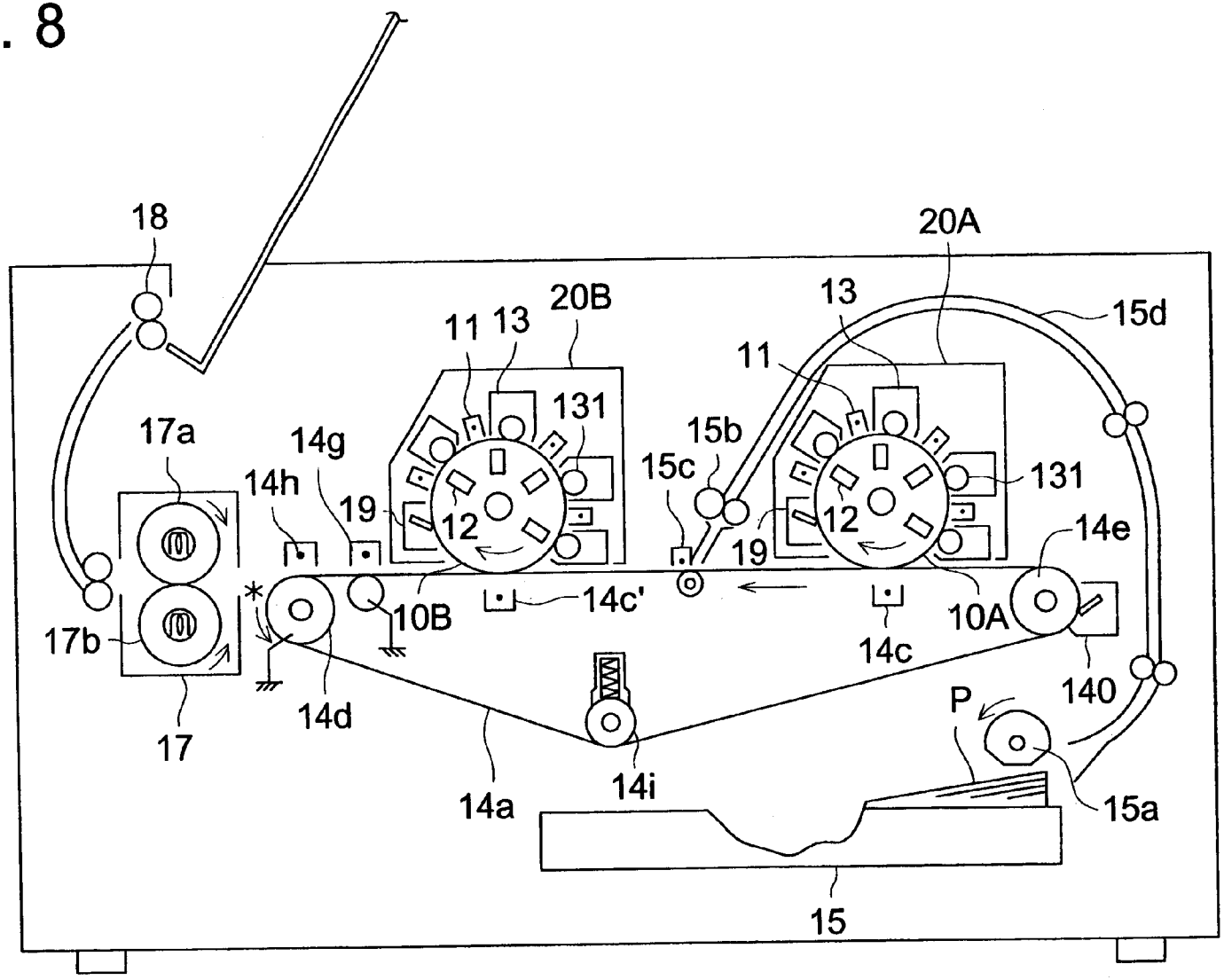
FIG. 8 shows a structural cross-sectional view of another example of image forming apparatus embodied in the present invention.

In FIG. 8, numeral 10A or 10B is a photoreceptor drum serving as a first and a second image bearing members, numeral 11 is a scorotron charger serving as a charging means for each color, numeral 12 is an exposure optical system serving as an image writing means for each color, numeral 13 is a developing device serving as a developing means for each color, numeral 14*a* is an intermediate transfer belt serving as an intermediate transfer element, numeral 14*c* and 14*c*' are first transfer devices serving as the first-1 and first-2 transferring means, numeral 14*g* is a second transfer device serving as the second transfer means, numeral 15*b* is a timing roller serving as a transfer sheet supplying means, numeral 15*c* is a paper-charger employing a sawtooth electrode, and numeral 17 is a fixing apparatus serving as fixing means.

First and second process units 20A, 20B, in each of which a plurality of scorotron chargers 11, exposure optical system 12 and developing device 13 are arranged around the peripheral surface of photoreceptor drum 10A or 10B serving as a first and a second image bearing members, are disposed at an upstream position and a downstream position on the upper surface of intermediate transfer belt 14*a*, respectively.

The photoreceptor drum 10A and 10B are so constituted that a photoreceptor layer such as a transparent conductive layer, a-Si layer or organic photoreceptor layer (OPC), is formed on the outer surface of a cylindrical base body formed of a transparent member such as, for example, an optical glass or a transparent acrylic resin, and is rotated clockwise in a direction of each arrow shown in FIG. 8.

Figure 9:
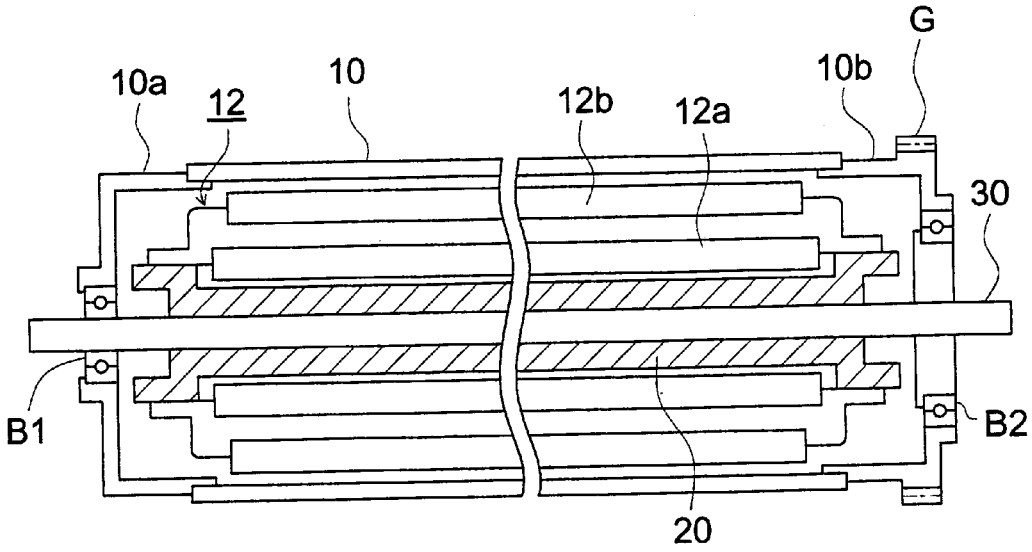
FIG. 9 shows a cross-sectional view of an image bearing member shown in FIG. 8.

As shown in FIG. 9, outer sleeves of bearings B1, B2 are inserted into flange members 10*a*, 10*b*, respectively, which are disposed at both ends of each of photoreceptor drums 10A, 10B to support it, and drum shaft 30, fixed to the apparatus main-frame, is inserted into inner sleeves of bearings B1, B2 to rotatably support each of photoreceptor drums 10A, 10B. Gear G, integrally formed on flange member 10*b*, is geared with a driving gear (not shown in the drawings), disposed in the apparatus main-frame, to rotate each of photoreceptor drums 10A, 10B at constant velocity in a predetermined direction.

Scorotron charger 11 serving as a charging means for each color, exposure optical system 12 serving as an image writing means for each color, and developing device 13 serving as a developing means for each color, are combined into one set, and four sets of them are provided for an image forming process for each color of yellow(Y), magenta (M), cyan (C) and black (k), and arranged in the order of Y, M, C, and K in the rotational direction of the photoreceptor drum 10 as shown by an arrow in FIG. 8.

Scorotron charger 11, serving as the charging means for each color, is disposed opposite photoreceptor drum 10A or 10B in a direction orthogonal to the rotating direction of photoreceptor drum 10A or 10B, and is comprised of a control grid, kept at a predetermined potential voltage with respect to the photoreceptor layer of photoreceptor drum 10A or 10B and a discharging electrode formed of, for example, a saw-toothed electrode, to perform a charging operation by corona discharging with the same polarity as that of toner (in the present example, negative charging), and to apply uniform potential voltage onto photoreceptor drum 10A or 10B. As the discharging electrode, a wire electrode may also be applicable.

Exposure optical system 12, serving as the image writing means for each color, is arranged inside photoreceptor drum 10A or 10B in such a manner that the exposure position on the photoreceptor drum 10A or 10B is located at the downstream side in the rotational direction of photoreceptor drum 10A or 10B with respect to scorotron charger 11 for each color. Exposure optical system 12 is comprised of line-type exposure element 12*a*, in which a plurality of LEDs (light emitting diode), serving as a light emitting element, are aligned array-like in a direction parallel to the drum shaft of photoreceptor drum 10A or 10B, and a lens holder (not shown in the drawings) for holding Selfoc-lens array 12*b*, serving as an equimultiple focal element. Image data of each color, read from images by a separate image reading apparatus and stored in a memory, are successively read from the memory and inputted as electronic signals into Exposure optical system 12. Other than LEDs, a light emitting element, in which a plurality of light emitting elements such as FLs (fluorescent material emission elements), ELs (electro-luminescence elements), PLs (plasma discharge elements), etc., are aligned array-like, would be available for the above purpose. It is favorable that the wavelength of the light emitting element, employed in the abovementioned embodiment, is in a range of 780–900 nm, in which the transparency of Y, M, C toners is high. In the present invention, however, since the image-wise exposure is carried out from the rear surface of the photoreceptor drum 10A or 10B, the shorter wavelength, having an insufficient transparency for color toners, may be allowable.

Developing devices 13, serving as a developing means for each color, have developing sleeves 131 formed of, for example, cylindrical non-magnetic stainless steel or aluminum material of 0.5–1 mm thickness, and of 15–25 mm outer diameter, developing sleeves being respectively rotated in the same direction as photoreceptor drum 10A or 10B at the developing position, while keeping a predetermined gap with respect to the peripheral surface of photoreceptor drum 10A or 10B, and developing casings 138, in which one-component or two-component developers for yellow(Y), magenta (M), cyan (C), and black (K) are respectively accommodated. Each developing device 13 has a predetermined gap of, for example, 100–1000 $\mu$m with respect to photoreceptor drum 10A or 10B with aid of a butting roller (not shown in the drawings) and is kept in non-contact with photoreceptor drum 10A or 10B. The developing bias voltage, having the same polarity as that of toner (in this embodiment, negative polarity) and composed of DC voltage and AC voltage, is applied onto the developing sleeve 131 to perform a non-contact reversal development. Thus, toner images for the reverse side and the obverse side of the transfer sheet are formed on photoreceptor drums 10A and 10B, respectively.

An intermediate transfer belt 14*a*, which is an intermediate transfer element, is an endless belt having the volume resistivity of $10^8$–$10^{12}$ Ω·cm, preferably $10^{10}$–$10^{11}$ Ω·cm, and is a seamless belt having 2 layer construction consisting of 0.3–2.0 mm thick semi-conductive film base body on the outside of which 5–50 $\mu$m thick fluorine coating is preferably conducted as a toner filming prevention layer, wherein the semi-conductive film base body is formed by dispersing the conductive material in silicon rubber, urethane rubber, etc. As a base body of the intermediate transfer belt 14*a*, in addition to the above, 0.05–0.5 mm thick semi-conductive film base body formed by dispersing conductive material in engineering plastics such as modified polyimide, thermohardened polyimide, ethylene tetra fluoroethylene copolymer, polyvinylidene fluoride, nylon alloy, etc., may also be used. Intermediate transfer belt 14*a* is stretched by being respectively inscribed by a driving roller 14*d*, the two grounding rollers disposed opposite second transfer device 14*g* and paper-charger 15*c*, driven roller 14*e* and tension roller 14*i*, and is rotated counterclockwise in a direction of an arrow shown in FIG. 8.

First transfer device 14*c*, serving as a first-1 transfer means, and first transfer device 14*c*', serving as a first-2 transfer means, are disposed opposite photoreceptor drum 10A and 10B with putting intermediate transfer belt 14*a* between them to form a transfer region between intermediate transfer belt 14*a* and photoreceptor drum 10A or 10B. DC voltage, having the opposite polarity of toner (in this embodiment, positive polarity), is applied onto first transfer devices 14*c*, 14*c*', to form a transferring electronic field in the transfer region. With this transferring electronic field, a toner image formed on photoreceptor drum 10A or 10B is transferred onto intermediate transfer belt 14*a* or the obverse side of recording sheet P, serving as a transfer sheet.

Second transfer device 14*g*, serving as a second transfer means, is disposed opposite the backup roller, being electronically conductive and grounded to the earth, with putting intermediate transfer belt 14*a* between them. DC voltage, having the opposite polarity of toner (in this embodiment, positive polarity), is applied onto second transfer device 14*g* to re-transfer a toner image borne on intermediate transfer belt 14*a* onto the reverse side of recording sheet P. Timing roller 15*c*, serving as a transfer sheet supplying means, feeds recording sheet P to the transfer region, synchronizing with a color toner image formed on photoreceptor drum 10B or a color toner image bone on intermediate transfer belt 14*a*.

Paper charger 15*c*, serving as a transfer material charging means, is preferably structured by a sawtooth electrode or a corona discharger, and is provided opposite backup roller 150A, being electronically conductive and grounded to the earth, with putting the intermediate transfer belt 14*a* between them, and DC voltage with the same polarity as that of toner (in the present example, negative polarity) is applied onto paper charger 15*c*, and recording sheet P is charged thereby and attracted onto intermediate transfer belt 14*a*.

Fixing apparatus 17, serving as a fixing means, which is comprised of two roller-shaped fixing members, namely, first fixing member 17*a* having a heater inside and second fixing member 17*b*, fixes a toner image onto recording sheet P by applying heat and pressure at a position between first fixing member 17*a* and second fixing member 17*b*.

Figure 10:
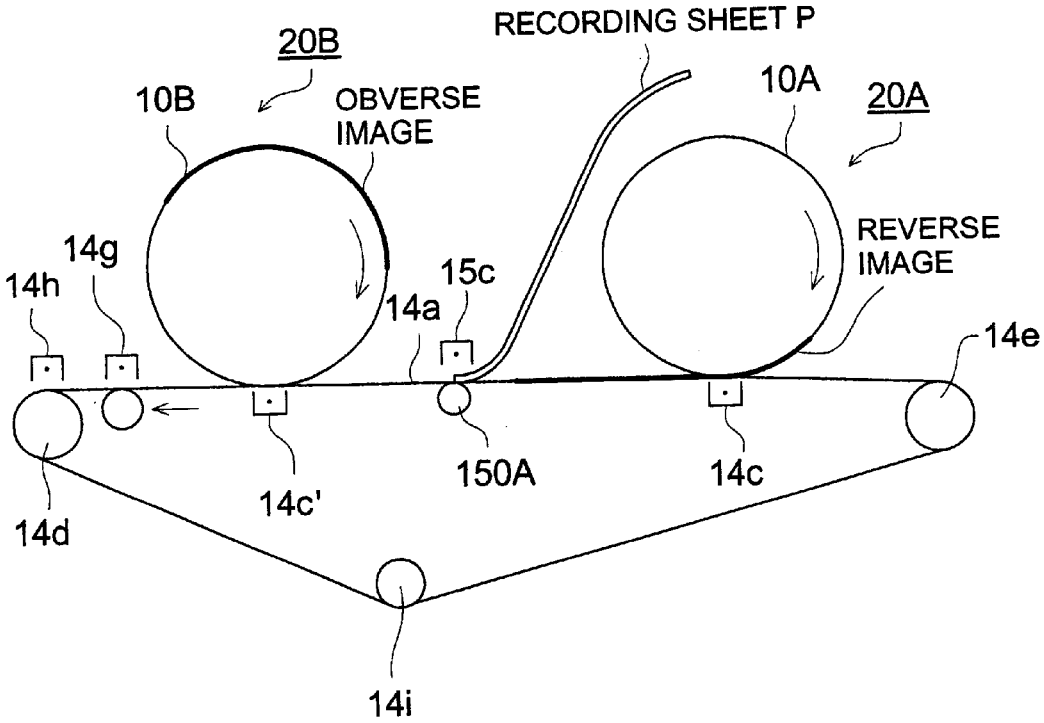
FIG. 10 shows an explanatory illustration of the image forming process of the image forming apparatus shown in FIG. 8.

Next, the image forming process will be detailed in the following. FIG. 10 shows an explanatory illustration of the image forming process.

Image data, which are read from a document by an imager element equipped in a separate image reading apparatus, or are compiled by a computer, are temporarily stored in a memory as individual image signals of yellow (Y), magenta (M), cyan (C) and black (k).

When image recording is stated, photoreceptor drums 10A and 10B are rotated clockwise as shown by an arrow in FIG. 8 by the start of a photoreceptor driving motor (not shown in the drawings), which drives gear G, integrally formed on flange 10*b*, through a driving gear (not shown in the drawings) attached to the photoreceptor driving motor, and simultaneously, application of potential voltage onto photoreceptor drum 10A and 10B is started by charging action of the scorotron charger 11 of yellow (Y).

At first, the image data, for the reverse side of the document, are inputted into each of exposure optical systems 12 equipped in first process unit 20A. Then, in first process unit 20A, a full color toner image is formed on photoreceptor drum 10A, serving as a first image bearing member, during one revolution of it, by overlapping toner images of yellow (Y), magenta (M), cyan (C) and black (k) by means of chargers 11, exposure optical systems 12 and developing devices 13. The full color toner image is temporarily transferred onto the surface of intermediate transfer belt 14*a* by means of first-1 transfer device 14*c*.

In parallel with the color image forming operation and the transferring operation, recording sheet P, serving as a transfer sheet, is fed from sheet feed cassette 15 by means of sending-roller 15*a*, and conveyed to timing roller 15*b* through sheet feed path 15*d*.

When a predetermined time has elapsed after the aforementioned inputting operation of the image data for the reverse side of the document, the image data, for the obverse side of the document, are inputted into second process unit 20B. Through the same process as that in first process unit 20A, a full color toner image is formed on photoreceptor drum 10B during one revolution of it, by overlapping toner images of each color. Incidentally, the image data is changed in advance so that each of color toner images of the obverse side, formed on photoreceptor drum 10B of second process unit 20B, is a mirror image with respect to the reverse side image previously formed.

Timing roller 15*b* commences to feed recording sheet P to intermediate transfer belt 14*a*, synchronizing with both the obverse side color toner image forming operation on photoreceptor drum 10B in second process unit 20B and the position of the reverse side color toner image already transferred on intermediate transfer belt 14*a*, so that the phases of color toner images of both obverse and reverse sides coincide each other, and the leading edge positions of both obverse and reverse color images coincide with the leading edge position of recording sheet P.

Recording sheet P, fed by timing roller 15*b*, is adhered to intermediate transfer belt 14*a* by charging it in the same polarity as that of toner by means of paper-charger 15*c*, and conveyed with intermediate transfer belt 14*a*. Initially, the reverse side color toner image, formed on photoreceptor drum 10B of second process unit 20B, is transferred onto the upper surface of recording sheet P by means of first-2 transfer device 14*c*', and then, the obverse side color toner image, transferred onto intermediate transfer belt 14*a* from photoreceptor drum 10A of first process unit 20A, is re-transferred onto the lower surface of recording sheet P by means of second transfer device 14*g*.

Succeedingly, recording sheet P, on both obverse and reverse sides of which full color toner images are transferred, is discharged by discharging action of paper separation AC discharger 14*h* to separate it from the surface of intermediate transfer belt 14*a*, and delivered onto the tray after fixing the full color toner images onto recording sheet P by means of fixing apparatus 17 and passing through sheet delivery roller 18.

On the other hand, the residual toner, remained on photoreceptor drums 10A, 10B after the transferring operation of the color images, are cleaned by means of cleaning device 19 and intermediate transfer element cleaning device 140 to provide for next color toner image forming and transferring operations.

Embodiment 4

In the Embodiment 4, the length of the transfer sheet in its conveyance direction is longer than the length of the conveyance path ranging from the first-2 transferring. position of first-2 transfer device 14*c*' to the second transferring position of second transfer device 14*g*, and the ambient humidity is higher than a predetermined humidity or the resistance of the transfer sheet is lower than a predetermined resistance. In this case, the control section performs controlling actions, so that the value of the transfer current or the transfer voltage (the bias voltage), applied to first-2 transfer device 14*c*' before the leading edge of the transfer sheet arrives at the second transferring position, changes into the different value after the leading edge of the transfer sheet passes through the second transferring position, and the absolute value of the transfer current or the transfer voltage, applied to first-2 transfer device 14*c*' after the leading edge of the transfer sheet passes through the second transferring position, decreases into a smaller value than the absolute value of the transfer current or the transfer voltage, applied to first-2 transfer device 14*c*' before the leading edge of the transfer sheet arrives at the second transferring position.

On the other hand, when the ambient humidity is lower than a predetermined humidity or the resistance of the transfer sheet is higher than a predetermined resistance, the control section does not change the value of the transferring voltage or the transferring current of first-2 transfer device 14*c*' while the transfer sheet passes.

According to the controlling actions performed in the Embodiment 4, it becomes possible to constantly form good toner images on the transfer sheet, without being influenced by ambient conditions and fluctuations of the resistance of the transfer sheet, and without generating any transferring unevenness like a stripped pattern, etc.

Embodiment 5

In the Embodiment 5, the length of the transfer sheet in its conveyance direction is longer than the length of the conveyance path ranging from the charging position of paper-charger 15*c* to the first-2 transferring position of first-2 transfer device 14*c*', and the ambient humidity is higher than a predetermined humidity or the resistance of the transfer sheet is lower than a predetermined resistance. In this case, the control section performs controlling actions, so that the value of the transfer current or the transfer voltage (the bias voltage), applied to first-2 transfer device 14*c*' before the trailing edge of the transfer sheet arrives at the charging position, changes into the different value after the trailing edge of the transfer sheet passes through the charging position, and the absolute value of the transfer current or the transfer voltage, applied to first-2 transfer device 14*c*' after the trailing edge of the transfer sheet passes through the charging position, decreases into a smaller value than the absolute value of the transfer current or the transfer voltage, applied to first-2 transfer device 14*c*' before the trailing edge of the transfer sheet arrives at the charging position.

On the other hand, when the ambient humidity is lower than a predetermined humidity or the resistance of the transfer sheet is higher than a predetermined resistance, the control section does not change the value of the transferring voltage or the transferring current of first-2 transfer device 14*c*' while the transfer sheet passes.

According to the controlling actions performed in the Embodiment 5, it becomes possible to constantly form good toner images on the transfer sheet, without being influenced by ambient conditions and fluctuations of the resistance of the transfer sheet, and without generating any transferring unevenness like a stripped pattern, etc.

Embodiment 6

In the Embodiment 6, the length of the transfer sheet in its conveyance direction is longer than the length of the conveyance path ranging from the charging position of paper-charger 15*c* to the second transferring position of second transfer device 14*g*, and the ambient humidity is higher than a predetermined humidity or the resistance of the transfer sheet is lower than a predetermined resistance. In this case, the control section performs controlling actions, so that the value of the transfer current or the transfer voltage (the bias voltage), applied to first-2 transfer device 14*c*' before the leading edge of the transfer sheet arrives at the second transferring position, changes into the different value after the leading edge of the transfer sheet passes through the second transferring position and before the trailing edge of the transfer sheet arrives at the charging position, and further changes into the different value after the trailing edge of the transfer sheet passes through the charging position, namely, the absolute value of the transfer current or the transfer voltage, applied to first-2 transfer device 14*c*' after the leading edge of the transfer sheet passes through the second transferring position and before the trailing edge of the transfer sheet arrives at the charging position, decreases into a smaller value than the absolute value of the transfer current or the transfer voltage, applied to first-2 transfer device 14*c*' before the leading edge of the transfer sheet arrives at the second transferring position and further decreases into a smaller value than the absolute value of the transfer current or the transfer voltage, applied to first-2 transfer device 14*c*' after the trailing edge of the transfer sheet passes through the charging position.

On the other hand, when the ambient humidity is lower than a predetermined humidity or the resistance of the transfer sheet is higher than a predetermined resistance, the control section does not change the value of the transferring voltage or the transferring current of first-2 transfer device 14*c*' while the transfer sheet passes.

According to the controlling actions performed in the Embodiment 6, it becomes possible to constantly form good toner images on the transfer sheet, without being influenced by ambient conditions and fluctuations of the resistance of the transfer sheet, and without generating any transferring unevenness like a stripped pattern, etc.

According to the present invention, it becomes possible to eliminate the density unevenness, like a stripped pattern, of toner images transferred on the surfaces of the transfer sheet, which occurs so often in conventional duplex image forming apparatus, which form toner images on the both sides of the transfer sheet by transferring a toner image formed on the image bearing member onto the intermediate transfer member, and to provide a duplex image forming apparatus, which makes it possible to stably form images having uniform and high-quality density characteristic, without being influenced by environmental conditions and the variation of electronic resistance of the transfer sheet.

Disclosed embodiment can be varied by a skilled person without departing from the spirit and scope of the invention.

What is claimed is:

1. A duplex image forming apparatus, comprising:

an image bearing member;

a toner image forming section to form a toner image on said image bearing member;

an intermediate transfer element, shaped like a belt and having a first surface onto which said toner image is transferred from said image bearing member and a second surface located opposite said first surface, to bear said toner image transferred from said image bearing member and to convey a transfer sheet while holding it on said first surface;

a transfer sheet charging device, disposed opposite a charging position and facing said first surface of said intermediate transfer element, to apply a bias voltage onto said transfer sheet at said charging position, so that said transfer sheet adheres onto said first surface of said intermediate transfer element;

a first transfer device, disposed opposite a first transferring position and facing said second surface of said intermediate transfer element, to transfer said toner image, formed on said image bearing member, onto said transfer sheet or said intermediate transfer element at said first transferring position;

a second transfer device, disposed opposite a second transferring position and facing said first surface of said intermediate transfer element, to transfer said toner image, borne on said first surface of said intermediate transfer element, onto said transfer sheet at said second transferring position; and a control section to control a transfer current or a transfer voltage applied to said first transfer device, wherein, under a condition that a length of said transfer sheet in its conveyance direction is longer than a length of a conveyance path ranging from said charging position to said second transferring position, said control section changes said transfer current or said transfer voltage, corresponding to each of three states, including a first state in which a leading edge of said transfer sheet has not arrived at said second transferring position, a second state in which said leading edge of said transfer sheet has passed through said second transferring position while a trailing edge of said transfer sheet has not arrived at said charging position and a third state in which said trailing edge of said transfer sheet has passed through said charging position.

2. The duplex image forming apparatus of claim 1, wherein said control section changes an absolute value of said transfer current or said transfer voltage in said second state into a smaller absolute value than that of said transfer current or said transfer voltage applied to said first transfer device in said first state.

3. The duplex image forming apparatus of claim 1, wherein said control section changes an absolute value of said transfer current or said transfer voltage in said second state into a larger absolute value than that of said transfer current or said transfer voltage applied to said first transfer device in said third state.

4. The duplex image forming apparatus of claim 1, further comprising:

a leading edge detecting device to detect a passage of said leading edge of said transfer sheet; and a trailing edge detecting device to detect a passage of said trailing edge of said transfer sheet, wherein said control section changes said transfer current or said transfer voltage based on signals detected by said leading edge detecting device and said trailing edge detecting device.

5. The duplex image forming apparatus of claim 4, wherein said leading edge detecting device and said trailing edge detecting device detect the passage of said leading edge of said transfer sheet and the passage of said trailing edge of said transfer sheet, respectively, by detecting a change of a charge current or a charge voltage of said transfer sheet charging device.

6. The duplex image forming apparatus of claim 1, further comprising:

a detecting device to detect a electronic resistance of said transfer sheet, or to detect a humidity in said duplex image forming apparatus, wherein said control section changes said transfer current or said transfer voltage applied to said first transfer device, when said electronic resistance, detected by said detecting device, is lower than a predetermined resistance value, or when said humidity, detected by said detecting device, is higher than a predetermined humidity value, while said control section does not change said transfer current or said transfer voltage applied to said first transfer device, when said electronic. resistance, detected by said detecting device, is higher than said predetermined resistance value, or when said humidity, detected by said detecting device, is lower than said predetermined humidity value.

7. The duplex image forming apparatus of claim 6, wherein said control section further changes said transfer current or said transfer voltage applied to said first transfer device in each of said three states, including said first state, said second state and said third state, corresponding to a detecting result of said detecting device.

8. The duplex image forming apparatus of claim 1, further comprising:

a second image bearing member; and a second toner image forming section to form a second toner image on said second image bearing member, wherein said second toner image, formed on said second image bearing member, is transferred onto said first surface of said intermediate transfer element.

9. A duplex image forming apparatus, comprising:

an image bearing member;

a toner image forming section to form a toner image on said image bearing member;

an intermediate transfer element, shaped like a belt and having a first surface onto which said toner image is transferred from said image bearing member and a second surface located opposite said first surface, to bear said toner image transferred from said image bearing member and to convey a transfer sheet while holding it on said first surface;

a transfer sheet charging device, disposed opposite a charging position and facing said first surface of said intermediate transfer element, to apply a bias voltage onto said transfer sheet at said charging position, so that said transfer sheet adheres onto said first surface of said intermediate transfer element;

a first transfer device, disposed opposite a first transferring position and facing said second surface of said intermediate transfer element, to transfer said toner image, formed on said image bearing member, onto said transfer sheet or said intermediate transfer element at said first transferring position;

a second transfer device, disposed opposite a second transferring position and facing said first surface of said intermediate transfer element, to transfer said toner image, borne on said first surface of said intermediate transfer element, onto said transfer sheet at said second transferring position; and a control section to control a transfer current or a transfer voltage applied to said first transfer device, wherein, under a condition that a length of said transfer sheet in its conveyance direction is longer than a length of a conveyance path ranging from said charging position or said second transferring position to said first transferring position, said control section changes said transfer current or said transfer voltage, corresponding to each of two states, including a first state in which said transfer sheet resides at both said first transferring position and one of said charging position and said second transferring position, and a second state in which said transfer sheet resides only at said first transferring position.

10. The duplex image forming apparatus of claim 9, wherein, in case that said transfer sheet resides at both said first transferring position and said second transferring position, said control section changes an absolute value of said transfer current or said transfer voltage in said first state into a smaller absolute value than that of said transfer current or said transfer voltage applied to said first transfer device in said second state.

11. The duplex image forming apparatus of claim 9, wherein, in case that said transfer sheet resides at both said first transferring position and said charging position, said control section changes an absolute value of said transfer current or said transfer voltage in said first state into a larger absolute value than that of said transfer current or said transfer voltage applied to said first transfer device in said second state.

12. The duplex image forming apparatus of claim 9, further comprising:

a leading edge detecting device to detect a passage of said leading edge of said transfer sheet, wherein said control section changes said transfer current or said transfer voltage, applied to said first transfer device, based on signals detected by said leading edge detecting device.

13. The duplex image forming apparatus of claim 12, wherein said leading edge detecting device detects the passage of said leading edge of said transfer sheet by detecting a change of a charge current or a charge voltage of said transfer sheet charging device.

14. The duplex image forming apparatus of claim 9, further comprising:

a second image bearing member; and a second toner image forming section to form a second toner image on said second image bearing member, wherein said second toner image, formed on said second image bearing member, is transferred onto said first surface of said intermediate transfer element.

* * * * *